US006773008B2

(12) United States Patent
Eberle

(10) Patent No.: US 6,773,008 B2
(45) Date of Patent: Aug. 10, 2004

(54) APPARATUS FOR TRANSPORTING SHEET-LIKE ARTICLES

(75) Inventor: Jurg Eberle, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/258,189

(22) PCT Filed: Feb. 6, 2001

(86) PCT No.: PCT/CH01/00078

§ 371 (c)(1),
(2), (4) Date: Oct. 18, 2002

(87) PCT Pub. No.: WO01/81216

PCT Pub. Date: Nov. 1, 2001

(65) Prior Publication Data

US 2003/0106775 A1 Jun. 12, 2003

(30) Foreign Application Priority Data

Apr. 20, 2000 (CH) ..... 799/00

(51) Int. Cl.[7] ..... B65H 29/04

(52) U.S. Cl. ..... 271/205; 271/206; 198/470.1; 198/474.1; 198/476.1; 198/803.2; 198/803.9

(58) Field of Search ..... 271/205, 206; 198/470.1, 474.1, 475.1, 476.1, 477.1, 867.02, 867.07, 803.3, 803.9

(56) References Cited

U.S. PATENT DOCUMENTS 3,794,315 A * 2/1974 Kaneko et al. ..... 269/56
4,512,457 A * 4/1985 Reist et al. ..... 198/470.1
4,905,986 A * 3/1990 Muller ..... 271/277
5,992,610 A * 11/1999 Dufour et al. ..... 198/377.06
6,213,463 B1 * 4/2001 Eberle et al. ..... 271/205

FOREIGN PATENT DOCUMENTS

| | | |
|---|---|---|
| DE | 25 25 496 A | 12/1976 |
| DE | 29 17 250 A | 10/1980 |
| WO | WO 99/55609 A | 11/1999 |

* cited by examiner

*Primary Examiner*—Christopher P. Ellis
*Assistant Examiner*—Mark A. Deuble
(74) *Attorney, Agent, or Firm*—Brinks Hofer Gilson & Lione

(57) ABSTRACT

The invention relates to a device for conveying flat objects (46), especially products of a printing works, which comprises successively arranged conveying elements that are moved along a continuous track (16) in a direction of conveyance (F). Individually controllable conveying clamps (22) are mounted on each conveying element (12) and are configured for laterally holding, with the clamp jaw thereof that is arranged in the plane of conveyance extending in the direction of conveyance (F), at least two objects (46), which are arranged in the plane of conveyance and in the direction of conveyance (F) while overlapping one another in an offset manner. The conveying clamps are mounted on the conveying elements in the plane of conveyance and in a direction of displacement (30), which is perpendicular to the continuous track (16), in a manner that permits them to be displaced to and fro between two positions (50, 50'). A control device (53) is configured for displacing the conveying clamps (22) from one position (50, 50') into the other.

11 Claims, 7 Drawing Sheets

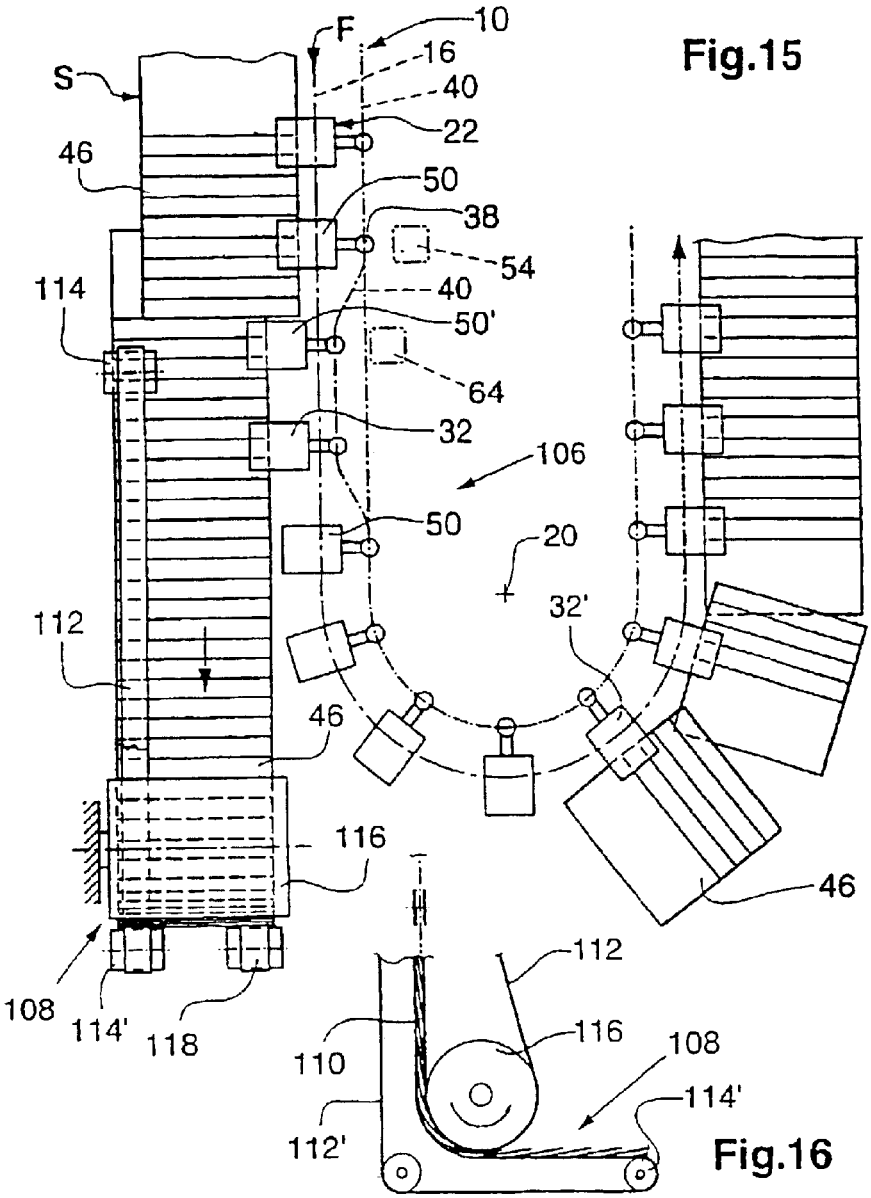
Fig.15
Fig.16
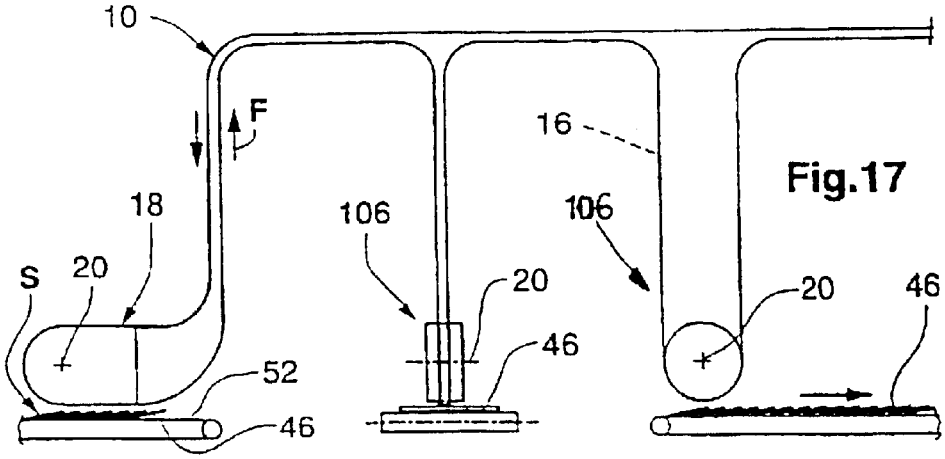
Fig.17

APPARATUS FOR TRANSPORTING SHEET-LIKE ARTICLES

RELATED APPLICATIONS

This application is a nationalization of PCT application PCT/CH01/00078 filed Feb. 6, 2001. This application claims priority from the PCT application and Swiss Application Serial No. 2000-0799/00 filed Apr. 20, 2000.

The present invention relates to an apparatus for transporting sheet-like articles, in particular printed products, according to the preamble of patent claim 1.

An apparatus of this type is disclosed in WO-A-99/55609. It has transporting clamps which are each fastened on a conveying element which is guided in a channel and is designed as a carriage. The conveying elements arranged one behind the other are connected in a flexible manner to one another. In order to ensure that the at least two articles retained laterally by a transporting clamp are not also gripped by the next-following transporting clamp, the distance between these transporting clamps is increased.

It is an object of the present invention to provide an apparatus of the generic type which allows flexibility in the processing of the articles and allows the articles to be received without the distance between the transporting clamps being changed.

This object is achieved by an apparatus which has the features of claim 1.

The apparatus according to the invention allows articles arranged in an imbricated formation to be conveyed and processed in sections. The transporting clamps each retain at least two of the articles of the imbricated formation, each of the articles only being retained by a single transporting clamp. The articles retained by a transporting clamp form a section, which can be displaced laterally on an individual basis in relation to the conveying direction as a result of the displaceability of the transporting clamps in relation to the conveying elements. This frees regions of the adjacent, non-displaced sections as well as regions of the section in question, which allow further transporting elements to act thereon or allow the access of processing stations.

Preferred embodiments of the subject matter of the invention are specified in the dependent claims.

The invention is explained in more detail hereinbelow with reference to exemplary embodiments illustrated in the drawing, in which, purely schematically:

FIG. 15 shows a view of a further embodiment of a transfer portion of the transporting apparatus according to the invention;

FIG. 16 shows a side view of part of the apparatus shown in FIG. 15; and FIG. 17 shows an apparatus for processing articles with a transporting apparatus according to the invention.

Figure 1:
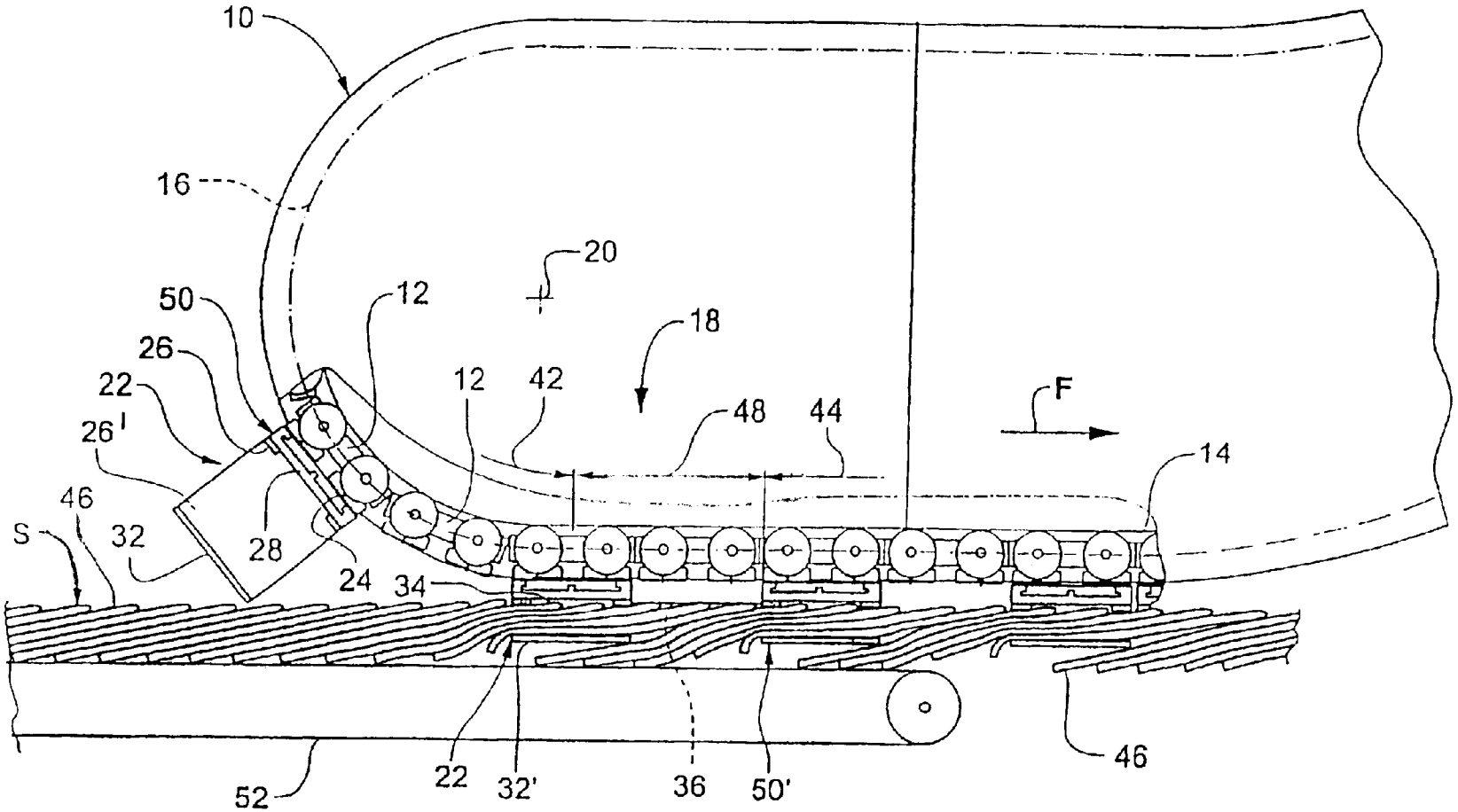
FIG. 1 shows a view of part of a transporting apparatus which, by means of its transporting clamps, is intended, in a receiving region, to receive articles, which are fed in sections in an imbricated formation, for further transportation.
Figure 2:
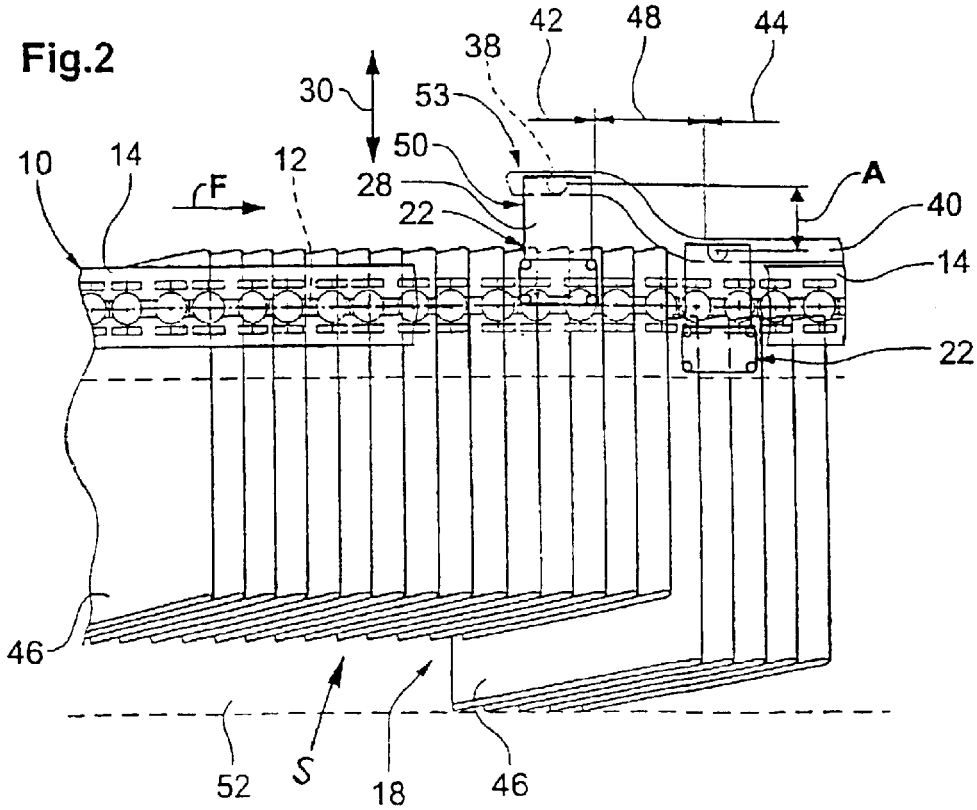
FIG. 2 shows a plan view of part of the transporting apparatus shown in FIG. 1.

A clamp-type transporter 10 shown in FIGS. 1 and 2 has conveying elements 12 which are designed as carriages and are arranged and mounted one behind the other in a cross-sectionally C-shaped guide channel 14, which forms a continuous circulatory path 16 for the conveying elements 12. The individual conveying elements 12, which are not connected to one another, form an uninterrupted row in the guide channel 14, in which case they butt against one another at the end sides and move one another forward by striking against one another. Upstream of a receiving portion 18, the channel runs, in a generally known manner, concentrically about the axis 20 of a spur wheel (not shown) which is driven in the conveying direction F and drives the conveying elements located in its region of action.

An individually controllable transporting clamp 22 is arranged in a displaceable manner on every second conveying element 12. A possible embodiment of the transporting clamps 22 will be described in conjunction with FIGS. 5 to 7. All that needs to be known for the time being, in order to understand the functioning of the apparatus, is that there is fastened on the relevant conveying elements 12 a plate-like guide rail 24 on which a slide 28, which forms a clamping element 26 of the transporting clamp, and is likewise of essentially plate-like design, is guided such that it can be displaced in a displacement direction 30, which runs at right angles to the circulatory path 16. The transporting clamp 22 also has second clamping element 26', which is of tongue-like design and can be rotated from an open position 32 into a clamping position 32'. The two clamping elements 26, 26' form a clamp mouth 34 which is arranged in a conveying plane 36, which runs in the conveying direction F and parallel to the circulatory path 16.

Mounted in a freely rotatable manner on each carriage 28 is a follower element 38, which is preferably designed as a roller and interacts with a guide element 40, which is preferably designed as a guide channel. The guide element 40 has portions 42, 44 which run parallel to, but at different distances from, the guide channel 14, and thus the circulatory path 16 of the guide elements 12. The different distances are designated in FIG. 2 by A, where A is at least equal to, but preferably greater than, the region, as measured from the side, in which the articles 46 which are to be transported are secured by means of the transporting clamps 22. The guide element 20 in each case, between the portions 42 and 44, has a displacement portion 48 with two successive, oppositely directed curve regions which merge one into the other and adjoin the portions 42 and 44 in a continuous manner. The portion 42 at a greater distance from the circulatory path 16 corresponds to a first position 50 of the transporting clamp 22 and the portion 44 corresponds to a second position 50'.

Arranged beneath the clamp-type transporter 10 is a feed conveyor 52, which is designed as a belt conveyor and by means of which sheet-like articles 46, in the present case printed products such as newspapers, periodicals or the like, arranged in an imbricated formation S are to be fed to the receiving portion 18, both the feed conveyor 52 and the clamp-type transporter 10, in the receiving portion 18, running parallel to one another and being driven at the same speed in the conveying direction F. As seen in plan view—as FIG. 2 shows—the clamp-type transporter 10 is arranged to the side of the feed conveyor 52, as seen in the conveying direction F, and the articles 46 project on the same side beyond the conveying belt of the feed conveyor 52.

The apparatus shown in FIGS. 1 and 2 functions as follows. The transporting clamps 22 are deflected about the axis 20, and fed to the receiving portion 18, with the clamping element 26 located in the open position 32 and with the slide 28 displaced into the first position 50. In this case, the clamping element 26, which is formed by the slide 28, positions itself against the imbricated formation S from above, in the region of the latter which projects laterally beyond the feed conveyor 52. Thereafter, the clamping element 26' is pivoted into the clamping position 32' by means of generally known control elements, as a result of which at least two, in the present case five, articles 46 are gripped from the side, and retained for being transported further, by the relevant clamp mouth. In order to ensure that this transporting clamp 22 does not also grip any articles 46 retained by the preceding transporting clamp 22, the transporting clamps 22, immediately after the clamp mouth 34 has closed, run through a displacement portion 48 in which the relevant articles 46, as seen in the conveying direction F, are moved laterally in the direction of the feed conveyor 52 and out of the region of action of the following transporting clamp 22, as can be gathered from FIG. 2 in particular. The articles are thus retained in sections and transported further with the imbricated formation S being maintained in the process.

The follower element 38 may be arranged on the slide 28 such that it can be changed over between an engagement position and a rest position, the follower element 38, in the engagement position, interacting with the guide element 40 and, in the rest position, being moved out of the region of action of the guide element 40. Such a transporting clamp is described in detail in the patent application entitled "Arrangement for transporting articles" and filed on Oct. 18, 2002, as Ser. No. 10/258,188.

Figure 3:
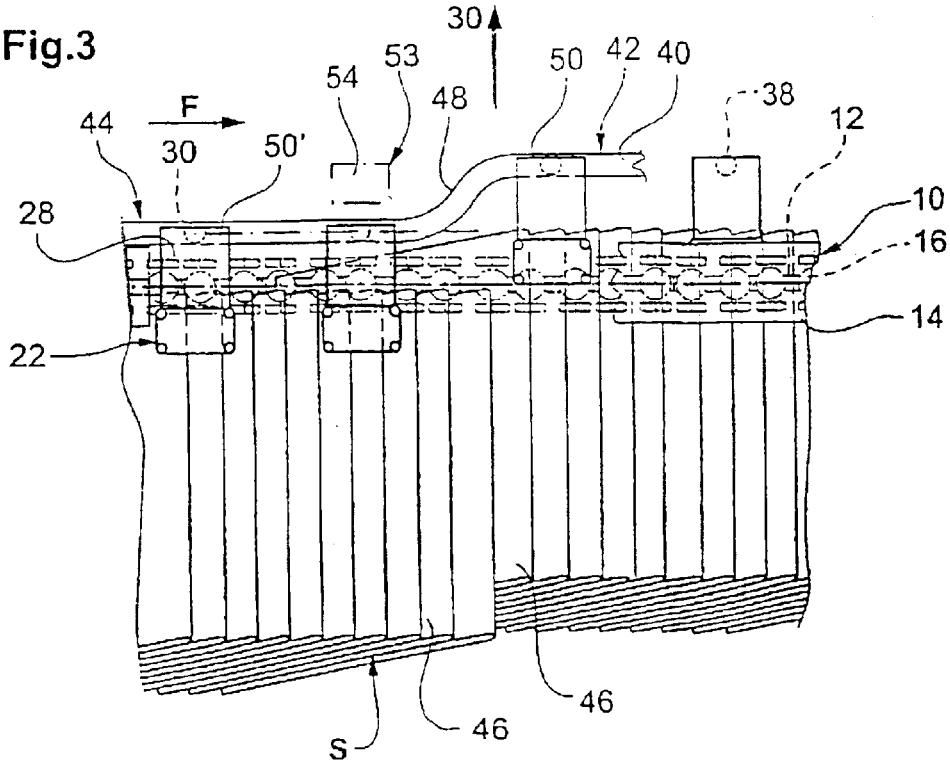
FIG. 3 shows a plan view of a further portion of the transporting apparatus according to FIGS. 1 and 2.

FIG. 3 shows a further portion of the clamp-type transporter 10, this portion being arranged downstream, as seen in the conveying direction F, of the receiving portion 18 illustrated in FIGS. 1 and 2. The portion 44 of the guide element 40—which corresponds to the second position 50' of the transporting clamps 22—is followed by a displacement portion 48 to a first portion 42 spaced apart, in turn, by a greater distance from the circulatory path 16 and thus corresponding to the first position 50 of the transporting clamps. Arranged at the downstream end of the portion 44 is a controlled changeover mechanism 54 of a control arrangement 53, said changeover mechanism being intended for moving the follower element 38 of predetermined transporting clamps 22 from the engagement position into the rest position outside the region of action of the guide element 40. By means of transporting clamps 22 of which the follower elements 38 have been displaced into the rest position, the articles 46 retained by said transporting clamps are transported further, with the transporting clamps maintaining their second position 50' in the process, as is indicated by the straight chain-dotted line which is indicated by the follower elements 38 of the two transporting clamps 22 located in the portion 44. In the case of the two transporting clamps 22 located in the portion 42, during transportation past the changeover mechanism 54, the follower elements 38 were left in their engagement position, with the result that the relevant articles 46 have been displaced back by virtue of the transporting clamps 22 being displaced into the first position 50.

Figure 4:
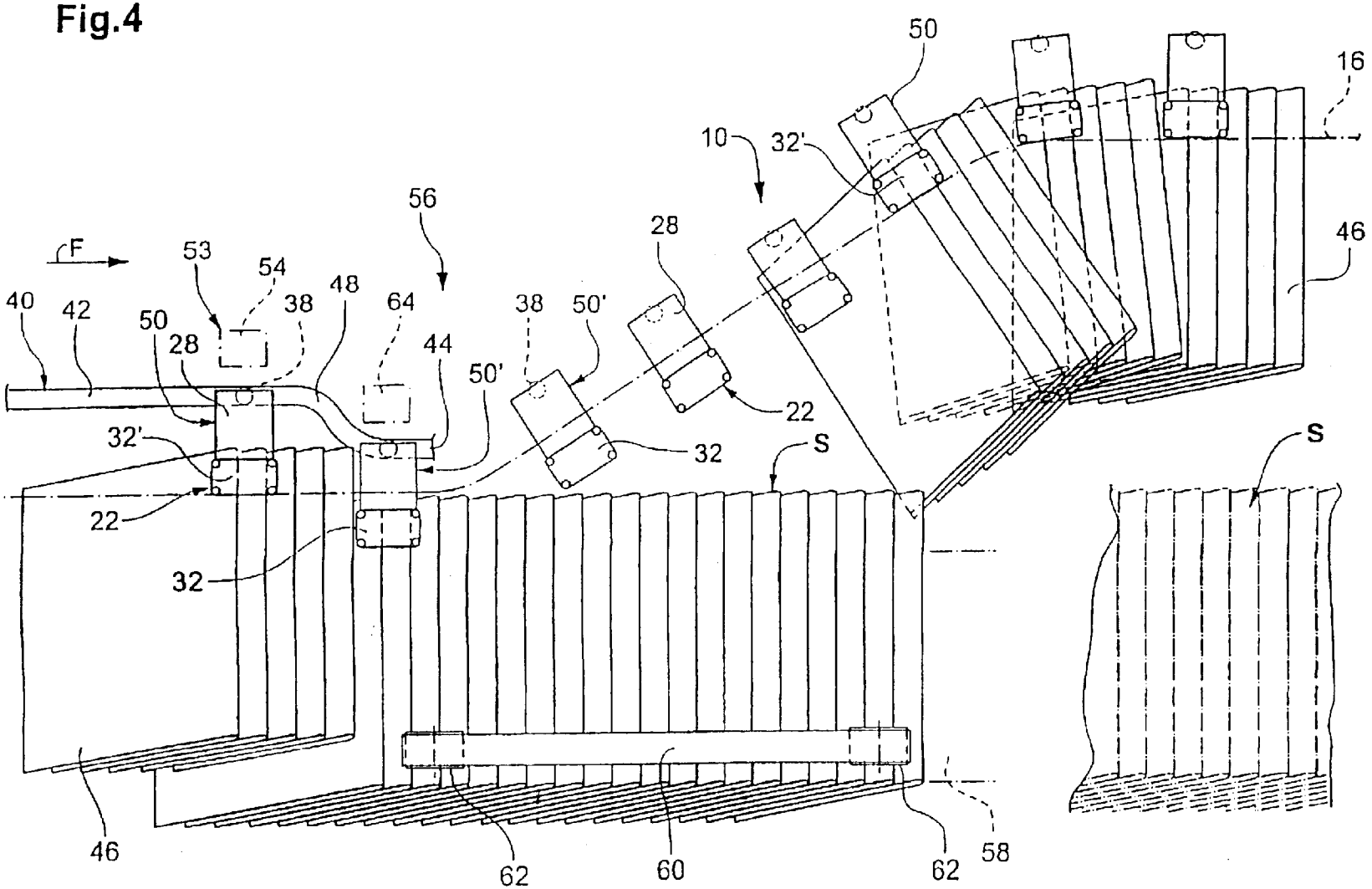
FIG. 4 shows a plan view of a further embodiment of a portion of the transporting apparatus according to the invention for optionally discharging articles transported by means of the transporting clamp.

FIG. 4 shows a transfer portion 56 of the clamp-type transporter 10, in which predetermined sections of the articles 46 fed in the conveying direction F by the transporting clamps 22 are transferred to a removal conveyor 58, which is designed as a belt conveyor, in order to be transported further. The circulatory path 16 runs rectilinearly into the transfer portion 56. Arranged laterally alongside said rectilinear portion, and parallel to the latter, is the removal conveyor 58, which is driven at the same speed, in the conveying direction F, as the conveying elements 12 of the clamp-type transporter 10. The transporting clamps 22 are conveyed to the transfer portion 56 in their first position 50—as is indicated with reference to a portion 42 of the guide element 40. In the transfer portion 56, the guide element 40 has a displacement portion 48 to a portion 44, which is spaced apart by a smaller distance from the circulatory path 16 of the conveying elements 12. Downstream of the displacement portion 48, the circulatory path 16 of the conveying elements 12 curves away from the removal conveyor 58, which is followed by a further rectilinear portion. A curve in the opposite direction then leads to a portion of the circulatory path 16 which, in turn, runs parallel to the removal conveyor 58, but in this case at such a distance therefrom that the articles 46 which are transferred to the removal conveyor 58 and the articles 46 which are transported further by means of the transporting clamps 22 are spaced apart from one another.

The removal conveyor 58, furthermore, has an endless pressure-exerting belt 60, which forms a conveying nip with the conveying belt and is arranged at such a distance from the circulatory path 16 that articles 46 which are to be transported further by means of the transporting clamps 22 cannot pass into the region of action of the pressure-exerting belt 60, whereas those articles which are displaced into the second position 50' and transferred to the removal conveyor 58 pass into the region of action of the pressure-exerting belt 60. The pressure-exerting belt 60 is guided by two deflecting rollers 62, the upstream one being arranged such that the conveying nip begins at a small distance downstream of the downstream end of the displacement portion 48.

Arranged upstream of the displacement portion 48 is a controlled changeover mechanism 54 of the control arrangement 53, said changeover mechanism being intended for changing over into the rest position the follower elements 38 of those transporting clamps 22 which convey the articles 46 they retain further and are not to transfer the articles to the removal conveyor 58. The follower elements 38 of those transporting clamps 22 which have to discharge the articles 46 they retain to the removal conveyor 58 are not changed over by the changeover mechanism 54. Arranged in a stationary manner at the downstream end of the displacement portion 48 is an opening mechanism 64, which is intended for pivoting into the open position 32 the clamp element 26' of those transporting clamps 22 which have to discharge the articles 46 they retain to the removal conveyor 58.

The follower elements 38 of the three transporting clamps 22 shown at the front, as seen in the conveying direction F, were changed over into the rest position as they moved past the changeover mechanism 54, as a result of which the relevant articles 46 have been transported past the pressure-exerting belt 60, with the first position 50 being maintained in the process. The four transporting clamps following these transporting clamps 22 have or discharge the articles 46 they retain to the removal conveyor 58 in that the follower elements 38 were left in the engagement position and the relevant transporting clamps 22, together with the articles 46 they retain, have been displaced into the second position 50' in the displacement portion 48. These articles 46 thus passed into the region of action of the removal conveyor 58 and of the pressure-exerting belt 60, to which they have been transferred by virtue of the relevant transporting clamps 22 being opened by means of the opening mechanism 64.

Downstream of the receiving portion shown, those transporting clamps 22 which have discharged the articles 46 to the removal conveyor 58 are displaced back into their first position 50 again. The successive sections of articles 46 fed to the removal conveyor 58 form, in turn, an imbricated formation S which, in terms of construction, corresponds to the imbricated formation S fed according to FIG. 1.

Figure 7:
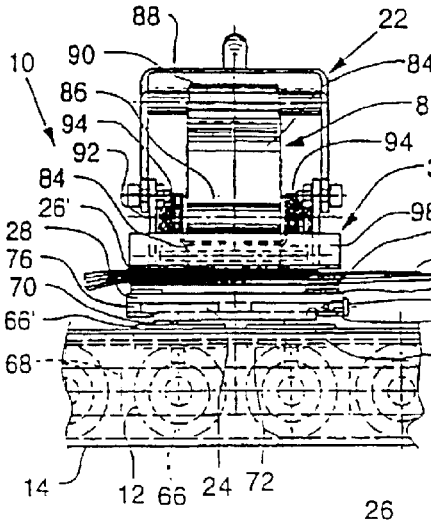
FIG. 7 shows the transporting clamp shown in FIGS. 5 and 6, in this case in a view in the direction of the arrow V from FIG. 5.
Figure 5:
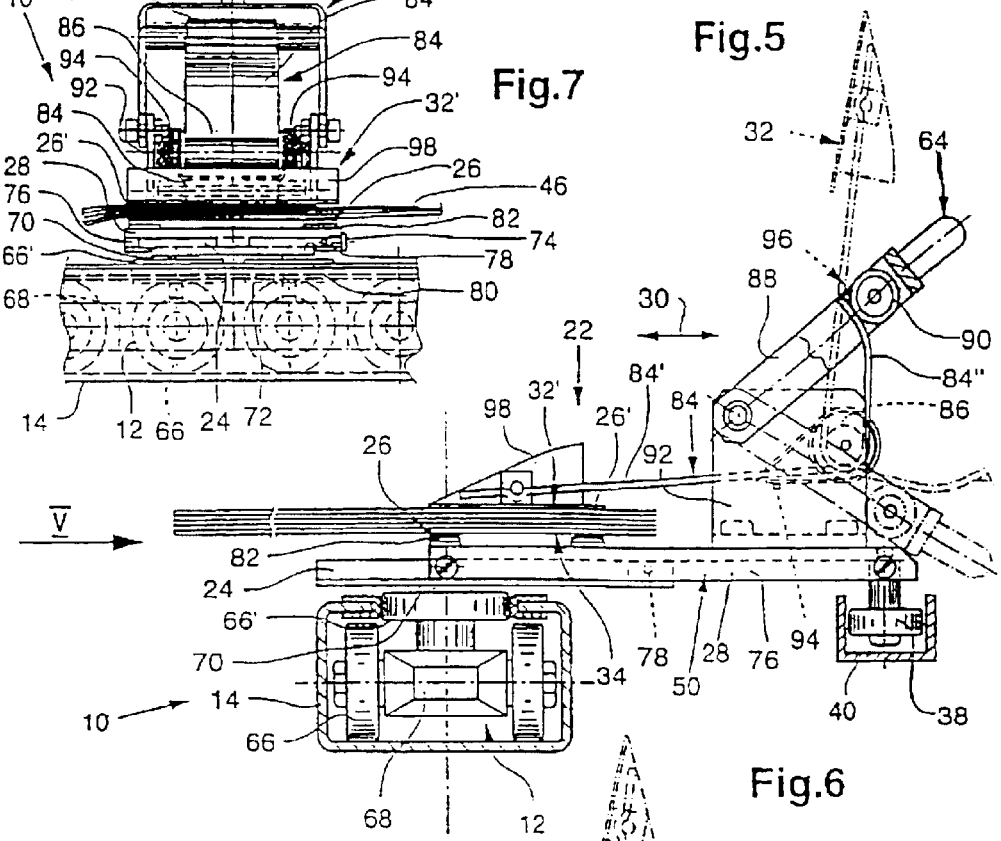
FIG. 5 shows a transporting clamp, which is mounted displaceably on a conveying element, in a first position.
Figure 6:
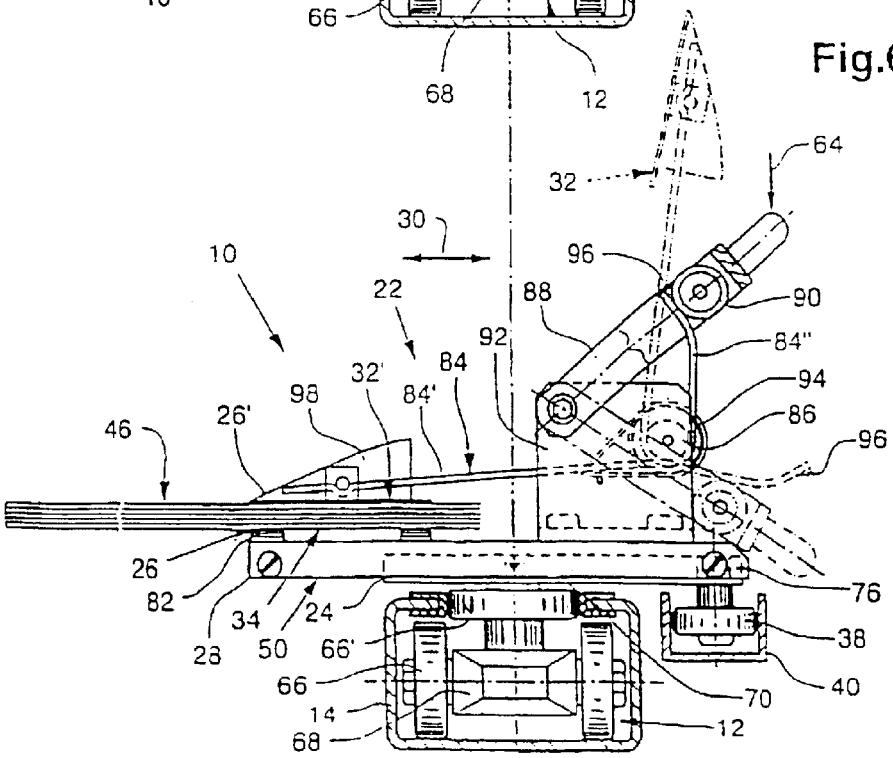
FIG. 6 shows, in the same illustration as FIG. 5, the transporting clamp from FIG. 5 displaced into a second position in relation to the conveying element.

FIGS. 5 to 7 show a transporting clamp 22 mounted in a displaceable manner on a conveying element 12. The carriage-like conveying element 12 is arranged in the cross-sectionally C-shaped guide channel 14 and is guided on the latter by means of four wheels 66 which are mounted in a freely rotatable manner with parallel axes. 68 designates the end side of the conveying element 12 by means of which the latter is intended for butting against the corresponding end side of the adjacent conveying element 12. Each conveying element 12 has two carrying elements 70 which are arranged one behind the other, project out of the guide channel 14 and on which there is mounted in a freely rotatable manner in each case a further wheel 66' which, for guiding the conveying element 12 laterally, interacts with the mutually facing borders of the guide channel 14.

Fastened on the carrying elements 70 is the plate-like guide rail 24, which has a central guide groove 72 running at right angles to the guide channel 14. A guide bead 74, which is integrally formed on the likewise plate-like slide 28, engages in said guide groove. Guide profiles 76 which are fastened on the slide 28 engage laterally around the guide rail 24 in order to keep the slide 28 in abutment against the guide rail 24. One of the guide profiles 76 has a central through-passage, in which a latching ball 78 is arranged. The latter is spring-loaded in the direction of the guide rail 24 and is intended for interacting with two latching depressions 80 corresponding to the first position 50 and second position 50'.

The follower element 38, which is designed as a roller, is mounted on the slide 28 such that it can be rotated freely about an axis which runs parallel to the axis of the further wheels 66' of the conveying element 12. Two bearing elements 82 are fastened on the slide 28 in the end region which is on the conveying-element side and directed away from the follower element 38, said bearing elements forming the fixed clamping element 26. The planar, moveable clamping element 26' interacts with said fixed clamping element. Said moveable clamping element is arranged at the free end region of a first leg 84' of a leaf spring 84 which runs through more or less 90° around a bearing shaft 86 and is intended, by way of its second leg 84", for interacting with an actuating roller 90 mounted in a freely rotatable manner on an actuating lever 88. The actuating lever 88 and the bearing shaft 86 are mounted on the lateral leg of a cross-sectionally U-shaped retaining element 92, which is fastened on the slide 28 by way of its connecting leg. On both sides of the leaf spring 84, the bearing shaft 86 has an opening spring 94 engaging around it, these opening springs, at one end, acting on a leaf spring 84 and, at the other end, being supported on the retaining element 92. The opening springs 94 are intended for subjecting the leaf spring 84 to a force which acts in the direction of the open position 32. In FIGS. 5 and 6, the clamping position 32' of the clamping elements 26' is indicated by solid lines and the open position 32 is indicated by chain-dotted lines.

The second leg 84" has a stop 96 at its end and the end region is curved such that, in the clamping position 32', the actuating roller 90 is kept in abutment against the stop 96 as a result of the force to which it is subjected by the second leg 84". The actuating lever 88 can be changed over, by means of the changeover mechanism 54 or stationary changeover guides, from the position corresponding to the clamping position 32' into the position corresponding to the open position 32 and back again. The clamping element 26' is provided with a wedge-like cover 98 which is intended, during displacement of the transporting clamp 22 from the first position 50 (FIG. 5) into the second position 50' (FIG. 6), to move beneath articles 46 retained by an adjacent transporting clamp 22, without damaging these articles.

In the case of the embodiment shown in FIGS. 5 to 7, the follower element 38 is not mounted on the slide 28 such that it can be changed over but, in this case, the guide elements 40 can be changed over by means of the control arrangement 53.

Figure 8:
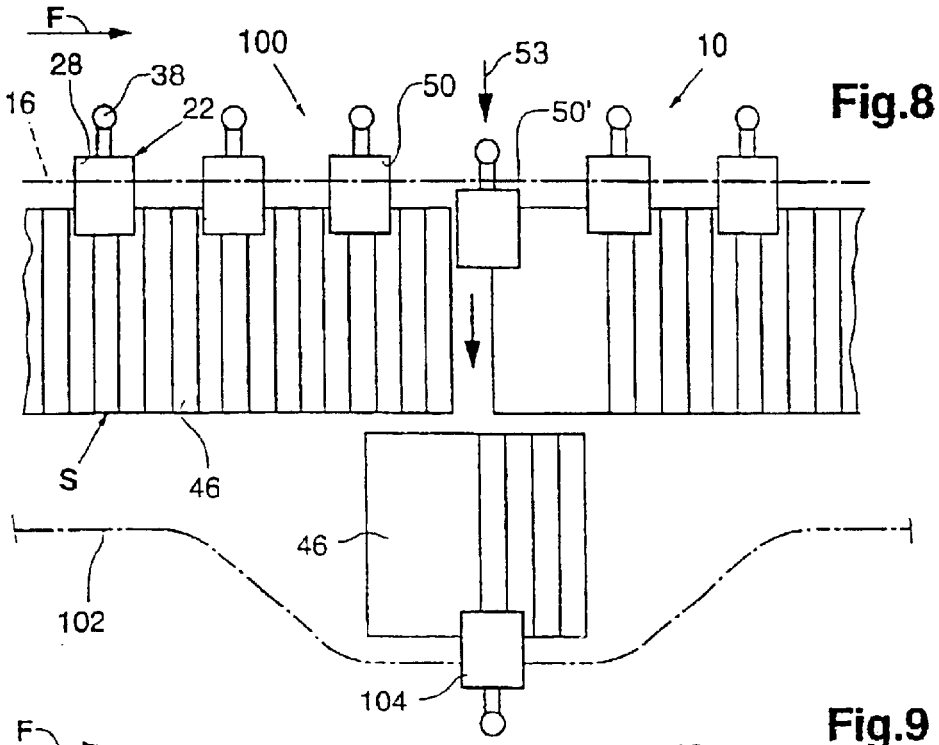
FIG. 8 shows a plan view of a re-imbricating portion of an apparatus according to the invention.
Figure 9:
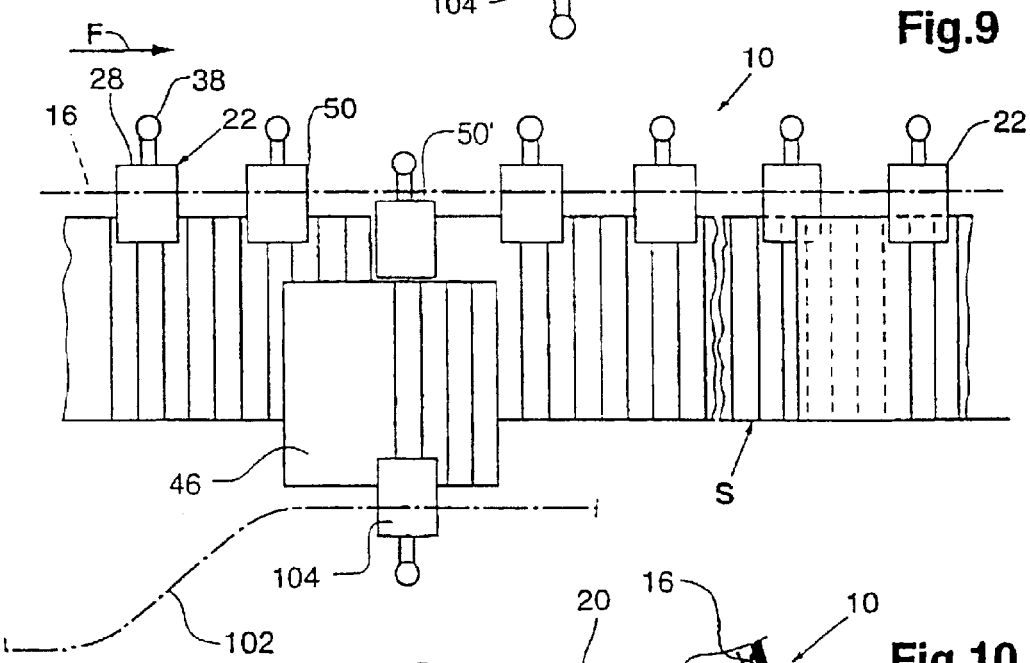
FIG. 9 shows part of the portion which is shown in FIG. 8, at a later point in time of a re-imbricating operation.

FIGS. 8 and 9 show the clamp-type transporter 10 in a re-imbricating portion 100 of the circulatory path 16. Each of the transporting clamps 22 is fed to this re-imbricating portion 100 in a state in which they are provided with articles 46. Running on the side of the articles 46 opposite to the circulatory path 16 is a further circulatory path 102, which has individually controllable clamps 104 which are driven synchronously to the transporting clamps 22, likewise in the conveying direction F, and may be of the same design as the transporting clamps 22. By means of the control arrangement 53, in an initial region of the re-imbricating portion 100, those transporting clamps 22 of which the articles 46 are to be re-imbricated are to be displaced from the first position 50, in the direction of the further circulatory path 102, into the second position 50'. In this initial region of the re-imbricating portion 100, the further circulatory path 102 runs at such a distance from the circulatory path 16 that the articles 46 retained by a transporting clamp 22 are introduced into the open clamp 104 during displacement from the first position 50 into the second position 50'. Downstream of this initial region, the above-mentioned distance increases such that the articles 46 received by the clamp 104 pass laterally out of contact, as seen in the conveying direction F, with the articles 46 which are retained by the rest of the transporting clamps 22 and are to be transported further. Until then, the further circulatory path 102 ran in the conveying surface of the clamp-type transporter 10. The further circulatory path then runs out of the conveying plane 36, in a direction transverse to the latter, and then in the direction of the circulatory path 16 of the conveying elements 12 again in order for the articles 46 retained by said clamp 104 to be transferred again to that transporting clamp 22 by means of which they have been fed to the re-imbricating portion 100. These articles 46, however, then rest on the articles 46 retained by transporting clamps 22 both following the relevant transporting clamp 22 and preceding the same, as can be seen with reference to those articles 46 which are retained by the transporting clamp 22 shown on the right-hand side in FIG. 9.

Figure 10:
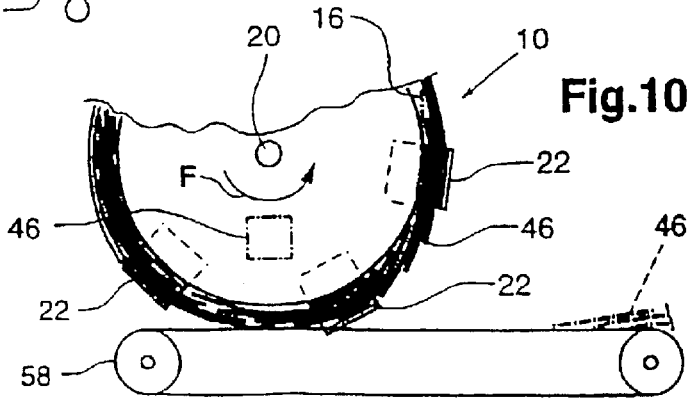
FIG. 10 shows a view of a transfer portion which is arranged downstream of the re-imbricating portion according to FIGS. 8 and 9 and is intended for discharging re-imbricated sections.
Figure 11:
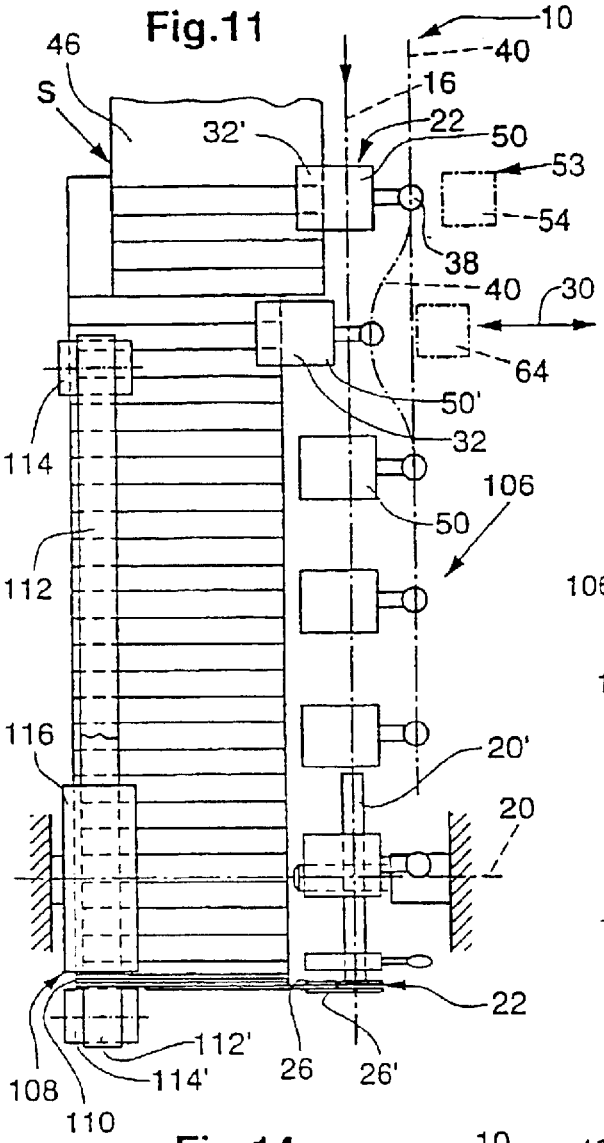
FIG. 11 shows a side view of a further embodiment of a transfer portion of the transporting apparatus according to the invention.
Figure 12:
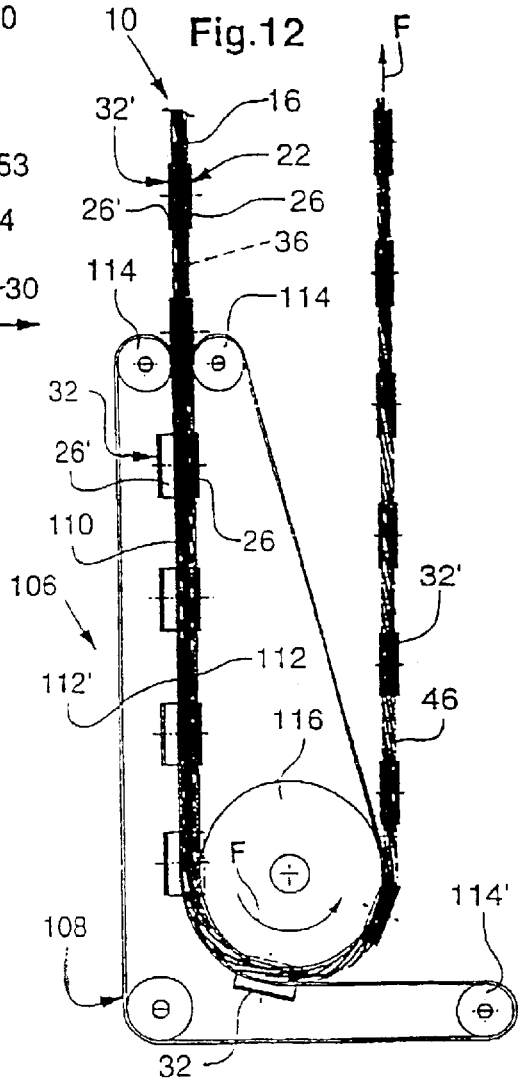
FIG. 12 shows a view of that portion of the transporting apparatus which is shown in FIG. 11.
Figure 14:
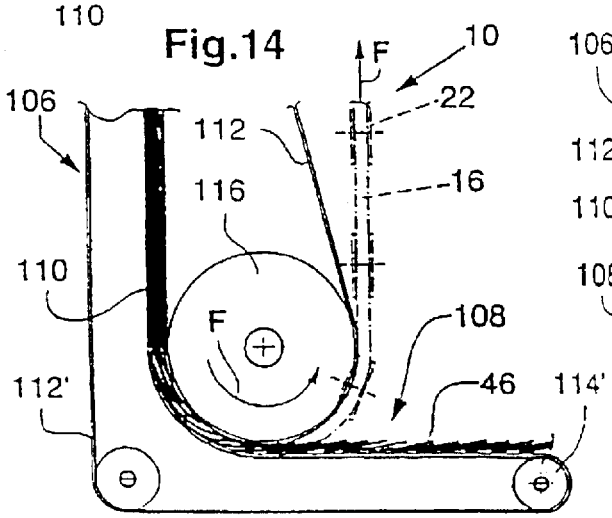
FIG. 14 shows, in the same illustration as FIG. 13, the portion from FIG. 13 at a later point in time during the transfer of printed products.

By way of the embodiment shown in FIGS. 8 and 9, it is possible for the imbricated formation S transported by the clamp-type transporter 10 to be prepared, by the formation of a separating location, such that the articles following the articles 46 re-imbricated by means of the clamp 104 can be ejected from the imbricated formation S and guided away by means of a removal conveyor 58, as is shown with reference to FIG. 10. The clamp-type transporter 10 is deflected about an axis 20 in a manner similar to that shown in FIG. 1, once again a driven spur wheel driving the conveying elements 12 in the conveying direction F. The re-imbricated articles 46 rest on the imbricated formation S on that side of the latter which is directed toward the spur wheel. A controlled opening mechanism 46 of the control arrangement 53 is intended for opening that transporting clamp 22 which follows one that transports a re-imbricated section of articles 46. When the transporting clamp 22 is opened vertically beneath the axis 20, the relevant articles 46 come to rest on the horizontally running removal conveyor 58, which is driven in the conveying direction F, whereupon they can be transported away, being detached from the preceding and following articles 46 in the process, as is shown with reference to that section of articles 46 which is indicated by chain-dotted lines.

FIGS. 11 to 14 show ejecting portion 106 of an apparatus according to the invention. The circulatory path 16 of the clamp-type transporter 10 runs from top to bottom to a spur wheel 20', which is driven in the conveying direction F about an axis 20, around said spur wheel and the vertically upward again. The axis 20 of the spur wheel 20' runs parallel to the conveying plane 36, which is defined by the transporting clamps 22. In an initial region of the ejecting portion 106, said initial region being located upstream of the spur wheel 20', the guide element 40 of the control arrangement 53 runs such that those transporting clamps 22 of which the follower elements 38 are not moved into the rest position from the region of action of the guide element 40 by means of the changeover mechanism 54 are moved from their first position 50 into the second position 50' and then back again into the first position 50. By means of an opening mechanism 64 of the control arrangement 53, the transporting clamps 22 displaced into the second position 50' are to be shifted from their clamping position 32' into the open position 32, in order to release the articles 46 fed to an ejecting conveyor 108 by the displacement. The transporting clamps 22 which do not retain articles 46 which are to be ejected are not displaced into the second position 50'.

The ejecting conveyor 108 is designed as a belt conveyor and has two continuous conveying belts 112, 112' which form a conveying nip 110. Said conveying belts are guided, at the start of the ejecting conveyor 108, around stationary deflecting rollers 114 with parallel axes, from where the active strands, which form the conveying nip 110, run to a deflecting wheel 116. The radially inner conveying belt 112, in relation to the deflecting wheel 116, runs around the deflecting wheel 116 and, from the latter, back to the associated deflecting roller 114. The radially outer conveying belt 112' engages through approximately 90° around the deflecting wheel 116 and, from there, runs tangentially to a further deflecting roller 114', which forms the end of the ejecting conveyor 108. The deflecting wheel 116 has a diameter corresponding to the spur wheel 20', with the result that the active strand of the conveying belt 112 runs along the conveying surface 36 defined by the clamp-type transporter 10, this being the case as long as the axis of the deflecting wheel 116 is aligned with the axis 20. In the direction of the axis 20, the ejecting conveyor 108 is spaced apart from the circulatory path 16 of the clamp-type transporter 10 such that the only articles 46 which pass into the conveying nip 110 are those of which the transporting clamps 22 have been displaced, in the direction of the ejecting conveyor 108, into the second position 50'.

Figure 13:
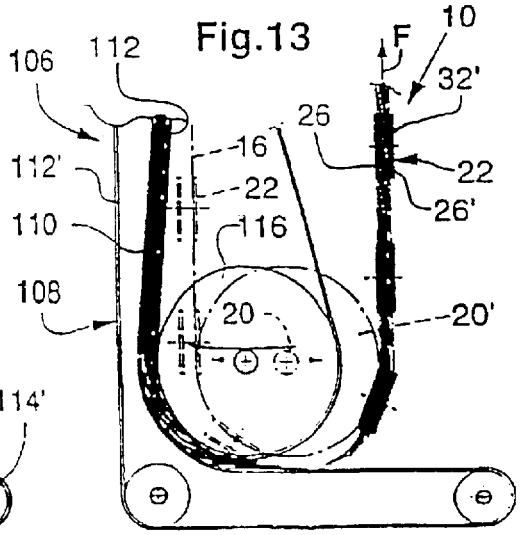
FIG. 13 shows a view of part of the portion shown in FIG. 12 during formation of a gap between articles which are to be transported further and articles which are to be discharged.

As FIG. 13 shows, the deflecting wheel 116 can be moved out of its position in which it is aligned with the spur wheel 20' (FIGS. 11, 12 and 14), along a circular-path section coaxial with the roller 114, in the direction of the outer conveying belt 112' and back again.

The apparatus shown in FIGS. 11 to 14 operates as follows. The transporting clamps 22 of articles 46 which are not to be ejected are conveyed further along the circulatory path 16, around the spur wheel 20', in a state in which they remain in their first position 50. In this case, the transporting clamps 22 always remain in the closed position 32'. The transporting clamps 22 of articles 46 which are to be ejected are displaced into the second position 50', as a result of which the relevant articles 46 pass into the conveying nip 110 of the ejecting conveyor 108. As soon as all the articles 46 transported by a transporting clamp 22 are retained in the conveying nip 110, the relevant transporting clamp 22 is opened and displaced back into the first position 50. Since the clamp-type transporter 10 and the ejecting conveyor 108 are driven at the same speed, the transporting clamps move synchronously with the relevant articles 46. In order for the articles 46 which are to be ejected to be released from the overlapping with the preceding articles 46 which are to be transported further by means of the clamp-type transporter 10, the deflecting wheel 16 is displaced at high speed away from the position in which it is aligned with the spur wheel 20' as soon as the articles 46 which are to be conveyed further by means of the transporting clamps 22 have left the conveying nip 110. This is the case when the transporting clamp 22 assigned to the first articles 46 which are to be ejected is located approximately vertically beneath the axis 20, as can be seen with reference to FIGS. 12 and 13. This forms a gap between the articles 46 which are to be ejected and those which are to be conveyed further, as FIG. 13 shows. The articles 46 which are to be ejected following the gap are then conveyed away in a state in which they rest on the conveying belt 112', the deflecting wheel 116 nevertheless then being displaced at lower speed again into a position in which it is aligned with the spur wheel 20'. The first articles 46, which are not to be ejected, are then, in a state in which they are retained by the transporting clamp 22, deflected around the spur wheel 20', where, as a result of the imbricated formation illustrated, they are easily separated from the articles 46 which are to be ejected.

FIGS. 15 and 16 show a further embodiment of the apparatus according to the invention in the ejecting portion 106. The circulatory path 16 of the conveying elements runs vertically from top to bottom to a deflecting location, through 180°, about an axis 20, which then runs at right angles to the conveying plane 36 defined by the clamp-type transporter 10 in the ejecting portion 106. In the initial region of the ejecting portion 106, the clamp-type transporter 10 is of the same design as is described in conjunction with the embodiment according to FIGS. 11 to 14. A changeover mechanism 54 displaces out of the region of action of the guide element 40 the follower elements 38 of those transporting clamps 22 which have to transport the articles 46 they retain further rather than feeding them to the ejecting conveyor 108. This is indicated with reference to the transporting clamps 22 which retain articles 46 and are shown downstream of the deflecting location. By means of the guide element 40, those transporting clamps 22 which have to feed the articles 46 they retain to the ejecting conveyor 108 are displaced from the first position into the second position 50'. As soon as all the articles 46 retained by a transporting clamp 22 are retained in the conveying nip 110 of the ejecting conveyor 108—which is of the same design as the ejecting conveyor 108 which has been described above and is shown in FIGS. 11 to 14, with the exception of the deflecting wheel 116 being mounted in a stationary manner—the relevant transporting clamps 22 are displaced into the open position 32 by means of the opening mechanism 64. The relevant transporting clamps 22 are then displaced back into their first position 50. The articles 46 fed to the ejecting conveyor 108 are conveyed, in the conveying nip 110, around the deflecting wheel 116 and then transported away in a state in which they rest on the conveying belt 112'. As can be gathered from FIG. 15, a further, rectilinear conveying belt 118 may be provided beneath the deflecting wheel 116 in order to support the ejected articles 46 at the border region remote from the ejecting conveyor 108.

FIG. 17 shows an apparatus according to the invention which is formed in the receiving portion 18 corresponding to FIGS. 1 and 2, in order for articles 46 which are fed in imbricated formation S by means of the feed conveyor 52, which is designed as a belt conveyor, to be received, and transported in the conveying direction F, in sections. Following the receiving portion 18, the circulatory path 16 runs vertically upward and, following an adjoining horizontal portion, it runs downward to an ejecting portion 106 according to FIGS. 11 to 14, the guide channel 14 being twisted through 90°, for example, in the vertically downwardly running portion, with the result that the axis 20 in the ejecting portion 106 runs at right angles to the axis 20 in the receiving portion 18. In this ejecting portion 106, articles 46 which have not been ejected are, in turn, conveyed further in the vertically upward direction, deflected into the horizontal there and fed vertically downward to a further ejecting portion 106. The guide channel 14, again, is twisted through 90° between the first and the second ejecting portions 106, with the result that the axis 20 in the second ejecting portion 106 runs parallel to that in the receiving portion 18. Following said ejecting portion 106, the circulatory path 16 runs vertically upward again and, thereafter, in the horizontal direction to a further station. Since each article 46 is retained by a single transporting clamp 22, each of these transporting clamps 22 retaining a plurality of articles 46, the circulatory path 16 may be curved as desired in space. Furthermore, the articles 46 retained by a transporting clamp 22 maintain their position in relation to one another without any changes. The apparatus according to the invention is suitable, in particular, for fitting out mailrooms in printing works, as is indicated with reference to FIG. 17.

What is claimed is:

1. An apparatus for transporting sheet like articles, in particular printed products, comprising:

conveying elements, which are moved in the conveying direction along a circulatory path and are arranged one behind the other; and individually controllable transporting clamps, which are each arranged on a conveying element and are intended for retaining laterally, as seen in the conveying direction, by means of their clamp mouth, which is arranged in a conveying plane running in the conveying direction, in each case at least two articles which are arranged in the conveying plane and overlap one another in an imbricated manner and in the conveying direction, said transporting clamps being mounted on the conveying elements such that they can be displaced back and forth between two positions at least more or less in the conveying plane and in a displacement direction running transversely to the circulatory path; and a feed conveyor arranged to convey articles in an imbricated formation into a receiving portion of said circulatory path;

wherein said transporting clamps, in the receiving portion, enclose and grip in each case at least two the articles, from the side and, wherein, at the end of the receiving section, before the respectively following transporting clamp grips articles, a control arrangement displaces the transporting clamps such that the gripped articles are located outside the region of the following transporting clamp.

2. The apparatus as claimed in claim 1, characterized in that, in the receiving portion of the circulatory path, the latter runs parallel to, and to the side of, the feed conveyor, which is designed as a belt conveyor and is intended for conveying the articles in an imbricated formation into the receiving portion.

3. An apparatus for transporting sheet like articles, in particular printed products, comprising:

conveying elements, which are moved in the conveying direction along a circulatory path and are arranged one behind the other;

individually controllable transporting clamps, which are each arranged on a conveying element and are intended for retaining laterally, as seen in the conveying direction, by means of their clamp mouth, which is arranged in a conveying plane running in the conveying direction, in each case at least two articles which are arranged in the conveying plane and overlap one another in an imbricated manner and in the conveying direction;

said transporting clamps being mounted on the conveying elements such that they can be displaced back and forth between two positions at least more or less in the conveying plane and in a displacement direction running transversely to the circulatory path: and a control arrangement for displaying transporting clamps from one of said two positions into the other;

wherein in a transfer portion of the circulatory path, the circulatory path runs parallel to, and to the side of a removal conveyor, and in that by means of the control arrangement, in the transfer portion, those transporting clamps which have to discharge the articles they retain onto the removal conveyor are to be displaced in the direction of the removal conveyor and those transporting clamps which have to convey the articles they retain through the transfer portion are to be left in their position further away from the removal conveyor or are to be displaced into this position.

4. The apparatus as claimed in claim 3, characterized in that the removal conveyor is a belt conveyor and, in a lateral region of the removal conveyor which is directed away from the circulatory path, the removal conveyor is assigned a holding down element, by means of which, downstream of the displacement of the relevant transporting clamps, the articles discharged by the latter are to be forced onto the removal conveyor.

5. An apparatus for transporting sheet-like articles, in particular printed products comprising:

conveying elements, which are moved in the conveying direction along a circulatory path and are arranged one behind the other;

individually controllable transporting clamps, which are each arranged on a conveying element and are intended for retaining laterally, as seen in the conveying direction, by means of their clamp mouth, which is arranged in a conveying plane running in the conveying direction, in each case at least two articles which are arranged in the conveying plane and overlap one another in an imbricated manner and in the conveying direction;

said transporting clamps being mounted on the conveying elements such that they can be displaced back and forth between two positions at least more or less in the conveying plane and in displacement direction running transversely to the circulatory path;

a control arrangement for displacing transportation clamps from one of said two positions into the other; and wherein running in a re-imbricating portion of the circulatory path, on the side of the articles opposite to the circulatory path, is a further circulatory path, which has individually controllable clamps driven in the conveying direction, by means of the control a arrangement, in an initial region of the re-imbricating portion, those transporting clamps of which the articles are to be re-imbricated are to be displaced in the direction of the further circulatory path and the relevant articles are to be displaced into the associated clamps, downstream of the initial region the distance between the circulatory path and the further circulatory path increases such that the articles received by the clamps pass out of contact with the articles retained by the transporting clamps (22), and then the further circulatory path runs out of the conveying surface, in a direction transverse to the latter, and then in the direction of the circulatory path again in order, in an end region of the re-imbricating portion, to transfer the articles retained by the clamps to the same transporting clamps by which they were fed to the re-imbricating portion.

6. An apparatus for transporting sheet-like articles, in particular printed products, comprising:

conveying elements, which are moved in the conveying direction along a circulatory path and are arranged one behind the other;

individually controllable transporting clamps, which are each arranged on a conveying element and are intended for retaining laterally, as seen in the conveying direction, by means of their clamp mouth, which is arranged in a conveying plane running in the conveying direction, in each case at least two articles which are arranged in the conveying plane and overlap one another in an imbricated manner and in the conveying direction; said transporting clamps being mounted on the conveying elements such that they can be displaced back and forth between two positions at least more or less in the conveying plane and in a displacement direction running transversely to the circulatory path;

a control arrangement for displacing transporting clamps from one position into the other; and wherein in an ejecting portion of the circulatory path, the circulatory path runs around a deflecting element, of which the axis is arranged parallel to the conveying plane, and in an initial region of the ejecting portion said initial region being located upstream of the deflecting element, the circulatory path runs parallel to, and to the side of, an ejecting conveyor; and wherein by means of the control arrangement, in the initial region, those transporting clamps which have to discharge the articles they retain to the ejecting conveyor are to be displaced in the direction of the ejecting conveyor and those transporting clamps which have to convey the articles they retain through the ejecting portion are to be left in their position further away from the ejecting conveyor or are to be displaced into this position.

7. The apparatus as claimed in claim 6, characterized in that the deflecting element and the ejecting conveyor can be moved relative to one another in directions away from one another, for forming a gap between the articles which are to be ejected and the articles which are to be conveyed further by means of the transporting clamps.

8. An apparatus for transporting sheet-like articles, in particular printed products comprising:

conveying elements, which are moved in the conveying direction along a circulatory path and are arranged one behind the other; and individually controllable transporting clamps, which are each arranged on a conveying element and are intended for retaining laterally, as seen in the conveying direction, by means of their clamp mouth, which is arranged in a conveying plane running in the conveying direction, in each case at least two articles which are arranged in the conveying plane and overlap one another in an imbricated manner and in the conveying direction;

said transporting clamps being mounted on the conveying elements such that they can be displaced back and forth between two positions at least more or less in the conveying plane and in a displacement direction running transversely to the circulatory path; and a control arrangement for displacing transportation clamps from one of said two positions into the other; and wherein in an ejecting portion, the circulatory path, in the conveying plane, runs around a deflecting element, of which the axis is arranged at least more or less at right angles to the conveying plane, in an initial region of the ejecting portion, said initial region being located upstream of the deflecting element, the circulatory path runs parallel to, and to the side of, an ejecting conveyor and, wherein, by means of the control arrangement, in the initial region, those transporting clamps which have to discharge the articles they retain to the ejecting conveyor are to be displaced in the direct on of the ejecting conveyor and those transporting clamps which have to convey the articles they retain through the ejecting region are to be left in the their position further away from the ejecting conveyor or are to be displaced into this position.

9. The apparatus as claimed in any one of claim 1, 2, 3, 4, 5, 6, 7 or 8, characterized in that:

each of the transporting clamps is connected to a follower element, and in that the control arrangement, at least in a portion of the circulatory path, has a guide element which interacts with the follower element of the relevant transporting clamp in order to displace transporting clamps from one position into the other.

10. The apparatus as claimed in any one of claim 1, 2, 3, 4, 5, 6, 7 or 8, characterized in that:

each of the transporting clamps is connected to a follower element, and in that the control arrangement, at least in a portion of the circulatory path, has a guide element which interacts with the follower element of the relevant transporting clamp in order to displace transporting clamps from one position into the other; and wherein certain portions of the guide element run parallel to the circulatory path and, in displacement portions of the circulatory path, the distance (A) between the guide element and the circulatory path changes continuously.

11. The apparatus as claimed in any one of claim 1, 2, 3, 4, 5, 6, 7 or 8, characterized in that:

each of the transporting clamps is connected to a follower element, and in that the control arrangement, at least in a portion of the circulatory path, has a guide element which interacts with the follower element of the relevant transporting clamp in order to displace transporting clamps from one position into the other; and wherein certain portions of the guide element run parallel to the circulatory path and, in displacement portions of the circulatory path, the distance between the guide element and the circulatory path changes continuously; and wherein arrange upstream of at least one displacement portion, as seen in the conveying direction, is a controlled changeover mechanism of the control arrangement, said changeover mechanism being intended for engaging the follower element of certain transporting clamps with the guide element or disengaging said follower elements therefrom.

* * * * *